US005967572A

United States Patent [19]

Sajfert et al.

[11] Patent Number: 5,967,572

[45] Date of Patent: Oct. 19, 1999

[54] LOCK CONTROL ARRANGEMENT FOR A VEHICLE DOOR

[75] Inventors: Drago Sajfert; Dieter Meyer, both of Wolfsburg, Germany

[73] Assignee: Volkswagen AG, Wolfsburg, Germany

[21] Appl. No.: 08/906,046

[22] Filed: Aug. 5, 1997

[30] Foreign Application Priority Data

Aug. 8, 1996 [DE] Germany ..... 196 31 976

[51] Int. Cl.[6] ..... E05B 3/00

[52] U.S. Cl. ..... 292/336.3; 292/DIG. 61

[58] Field of Search ..... 292/336.3, DIG. 61, 292/DIG. 64; 29/434, 436; 267/28, 259, 272

[56] References Cited

U.S. PATENT DOCUMENTS 3,815,943 6/1974 Haas ..... 292/254
4,502,720 3/1985 Fayerman et al. ..... 292/341.17
5,342,103 8/1994 Tame et al. ..... 292/341.17
5,618,068 4/1997 Mitsui et al. ..... 292/201

*Primary Examiner*—Darnell M. Boucher
*Attorney, Agent, or Firm*—Baker & Baker, L.L.P.

[57] ABSTRACT

A vehicle door lock control arrangement includes a spring lock and an external actuator which is releasably connected to a release lever on the lock side. The release lever can be pivoted between a rest position and a release position against the force of a first spring to act on a pawl which normally retains the lock in its locked position. A further spring is also provided which prevents the lock from being partially released when it is connected to the external actuator. For this purpose, the further spring normally holds the release lever in the rest position but its connection to the release lever is automatically released during the initial actuation of the release lever.

5 Claims, 2 Drawing Sheets

LOCK CONTROL ARRANGEMENT FOR A VEHICLE DOOR

BACKGROUND OF INVENTION

This invention relates to lock control arrangements for controlling locks in vehicle doors.

During the assembly of a lock control arrangement for a vehicle door, and specifically when the external actuator for the lock, which may, for example, be integrated in the exterior door handle, is connected to the lock release lever, it may happen that the lock is partially released unless the lock control arrangement has a special provision to prevent this. The result is that the lock is then secured, but it cannot be unlocked again.

In order to counteract this, a so-called pin blocking arrangement has been developed. In this arrangement, the lock release lever is blocked relative to the lock housing by a pin. When the lock release lever has been connected to the external actuator, this pin is removed, after which the normal functioning of the lock is permitted. When the pin is removed, it can sometimes drop into the lock control arrangement or into the door and thus cause malfunctions or undesirable noises. Moreover, it is not possible to use this pin blocking arrangement when a so-called unit carrier is used for fitting the door together in which the door lock control, a window winder and other components are preassembled on a board, and this board is attached to the interior pawl of the door. When the release lever has then been connected to the external actuator, there is no longer any access to the specific location to be able to remove the blocking pin.

SUMMARY OF THE INVENTION

Accordingly, it is an object of the present invention to provide a lock control arrangement for a vehicle door which overcomes the above-mentioned disadvantages of the prior art.

Another object of the invention is to provide a vehicle door lock control arrangement which prevents release of the lock during assembly in such a way that it can be used effectively even when a unit carrier is used.

These and other objects of the invention are attained by providing a lock control arrangement having a spring which holds the lock release lever in the inactive position during assembly and which is automatically disengaged from the lock release lever during the initial operation of the release lever after assembly.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
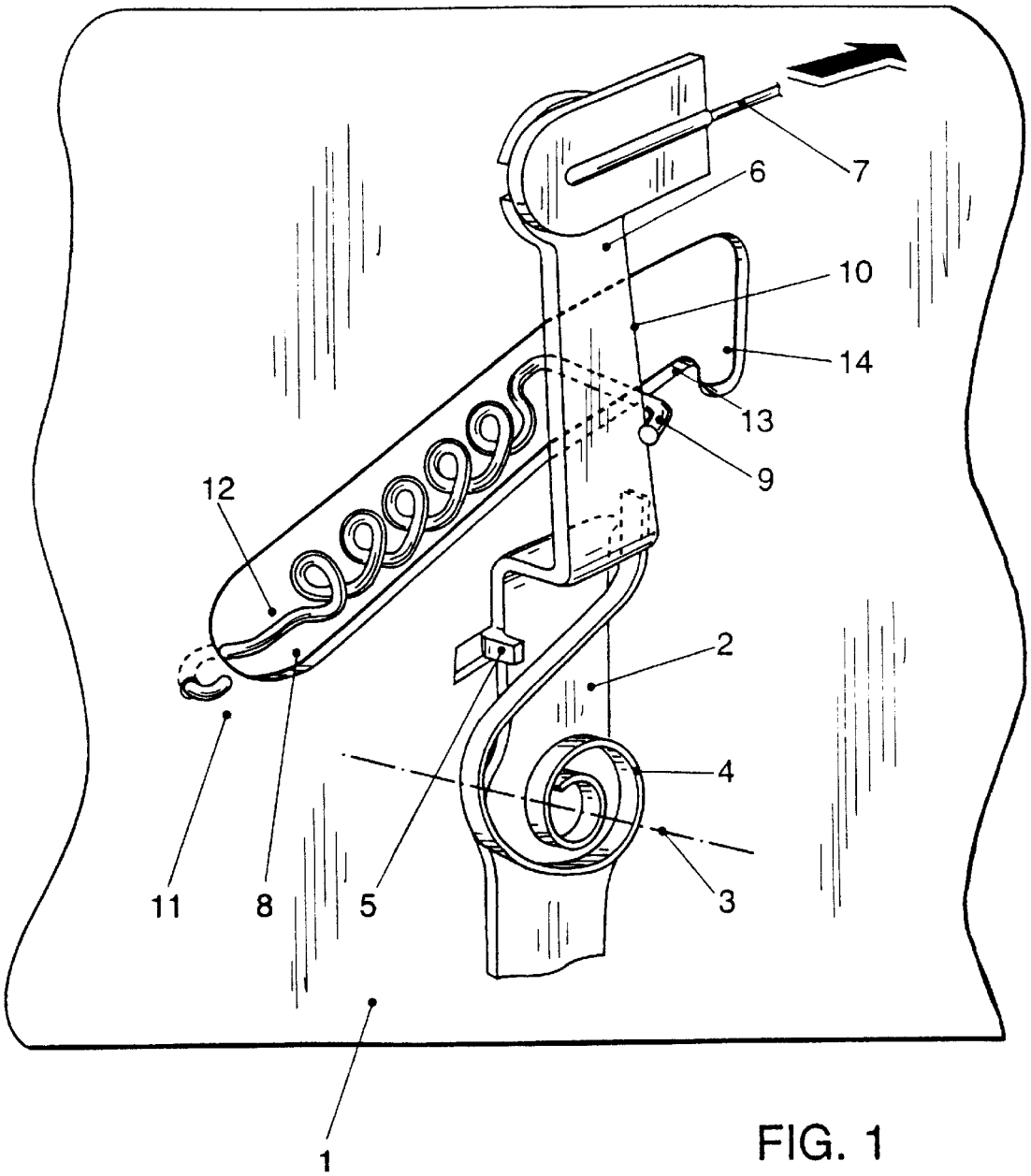
FIG. 1 illustrates the region around the release lever of a spring lock for a vehicle door in a representative embodiment of the invention with the spring lock in the delivery condition.

In the typical arrangement of the invention shown in the drawings, a release lever 2, which is mounted on a wall 1 of the spring lock arrangement, can be pivoted about an axis 3 between a rest position (as shown) and a released position. The release lever 2 is held in its rest position against a stop 5 by the force of a first spring 4. Acting on the free end 6 of the release of the release lever 2 is a tension element 7 which is connected to the external lock actuator (not illustrated), for example in the exterior door handle. The tension element is arranged so that when the door handle is operated the release lever 2 is pivoted into the lock release position against the spring force to act on a pawl which normally retains the lock in the locked position. As the lever moves to the release position, the lock is released in a conventional manner by further levers (not shown) connected to the release lever 2, and a positive locking connection between the lock and a locking bolt is released.

In the delivery condition of the spring lock arrangement, a further spring 8 has a hook-like portion 9 at one end engaging an edge 10 of the release lever 2 facing the release position The other end 11 of the spring 8 is attached to the wall 1. The wall 1 has a slot 12 in which the hook-like portion 9 of the further spring 8 is moved along to the right as seen in FIG. 1, when the release lever 2 is pivoted out of its rest position. The attachment location of the further spring 8 to the wall 1 is arranged so that a component of the spring force constantly urges the hook-like portion 9 downwardly against the lower edge of the slot 12. At the right end of the slot 12 as seen in the drawing, the slot is provided with an undercut 14.

When the lock control arrangement has been fitted into the door, the free end of the tension element 7 must be connected to the external actuator. In this case, the workman must be careful not to impose any longitudinal force on the tension element 7, at least not such a force that would cause the release lever to be pivoted and thus moved out of its rest position because the lock would then be partially released with the consequences described above. To resist such movement, the hook-like portion 9 of the further spring 8, which engages the edge of the release lever 2 and the further spring has a spring force substantially greater than that of the first spring 4. The workman can thus make the connection between the lock and the external actuator without running the risk of partially releasing the lock, because the resistance provided by the further spring 8 is sufficient to avoid this.

Figure 2:
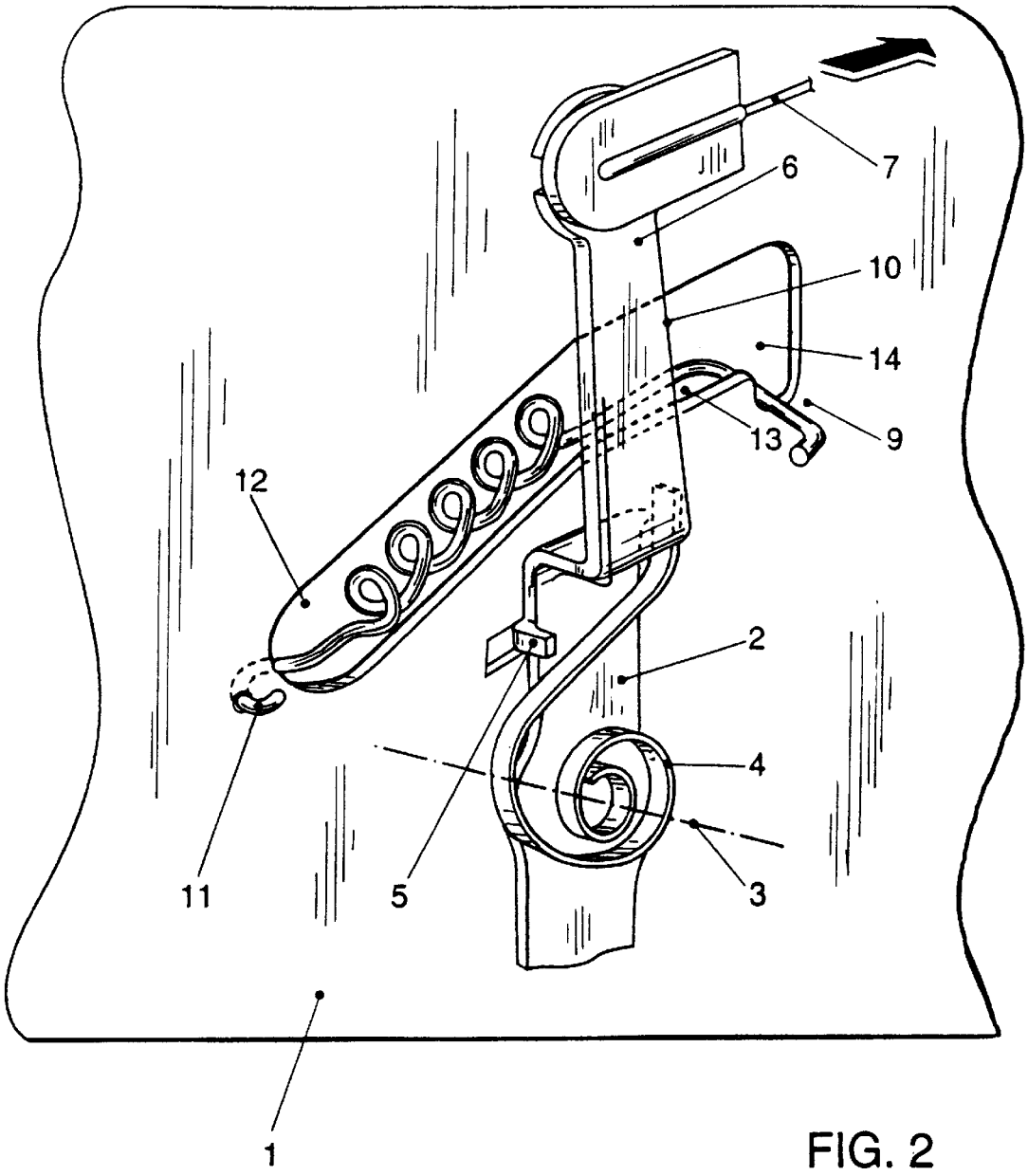
FIG. 2 illustrates the spring lock of FIG. 1 in the installed condition after initial actuation of the release lever.

When the assembly of the lock and the exterior actuator, including their connection, has been completed, the workman actuates the external actuator. In doing so, he causes the release lever 2 to be pivoted clockwise by the tension element 7. The pivoting takes place against the force of both the springs 4 and 8. As soon as the hook-like portion 9 reaches the undercut 14, it is pulled into it because of the geometrical arrangement of the further spring 8 and the hook 9 is then retained in the undercut 14, as illustrated in FIG. 2. After this initial actuation of the release lever 2, it is only acted upon only by the first spring 4, which provides a sufficient restoring force for the release lever during subsequent actuations.

In the event that the spring lock and/or the external actuator having to be dismantled at some time, for example in the course of a repair, which is only possible after previously separating the connection of the two components, the lock control arrangement is returned to the delivery condition before it is reinstalled. In other words, the further spring 8 is again positioned so that the hook-like portion 9 engages the edge 10 of the release lever 2. The further assembly then takes place in the same way as the initial installation.

Although the invention has been described herein with reference to a specific embodiment, many modifications and variations therein will readily occur to those skilled in the art. Accordingly, all such variations and modifications are included within the intended scope of the invention.

We claim:

1. A lock control arrangement for a vehicle door having a spring lock and an external lock actuator comprising:

a release lever releasably adapted to be connected to the external lock actuator and pivotable from a rest position into a release position where it releases a pawl which normally retains the lock in the locked position, a first spring urging the release lever into its rest position; and a further spring having a first end adapted to alternatively engage the release lever or a hook on a wall of the spring lock near the release position of the release lever and having a second end attached to the wall of the spring lock, the further spring being arranged to urge the release lever toward the rest position to prevent the lock from being partially released when it is connected to the external actuator and adapted to be automatically released from the release lever during initial actuation thereof.

2. A lock control arrangement as claimed in claim 1 wherein the spring force of the further spring is substantially greater than that of the first spring.

3. A lock control arrangement as claimed in claim 1 wherein the connection of the further spring to the release lever includes a hook configuration of the first end of the further spring, and wherein that spring end slidably engages a part of the release lever which faces the release position of the lever.

4. A lock control arrangement as claimed in claim 1 wherein the first end of the further spring is guided in a wall slot extending in the direction of movement of the release lever and the second end of the further spring is attached to the wall of the spring lock so that, when the release lever is pivoted, a component of the force acting on the first end of the further spring is directed perpendicular to a wall slot direction.

5. A lock control arrangement as claimed in claim 4 wherein, at an end of the wall slot adjacent to the release position, the slot has an undercut in which the first end of the further spring is received during initial actuation of the release lever, after which the release lever is acted upon only by the first spring.

* * * * *